United States Patent [19]

Tharp

[11] Patent Number: 4,730,194

[45] Date of Patent: Mar. 8, 1988

[54] AIRBORNE TRANSMITTING ANTENNA AND METHOD FOR DEPLOYING SAME

[75] Inventor: Nelson B. Tharp, Ellicott City, Md.

[73] Assignee: Westinghouse Electric Corp., Pittsburgh, Pa.

[21] Appl. No.: 746,893

[22] Filed: Jun. 20, 1985

[51] Int. Cl.[4] ..... H01Q 1/30

[52] U.S. Cl. ..... 343/707; 343/705; 343/877

[58] Field of Search ..... 343/705, 706, 707, 708, 343/877

[56] References Cited

U.S. PATENT DOCUMENTS

| | | | |
|---|---|---|---|
| 2,432,371 | 12/1947 | Berberich | 343/707 |
| 3,496,567 | 2/1970 | Held | 343/707 |
| 3,724,817 | 4/1973 | Simons | 258/1.4 |
| 3,823,402 | 7/1974 | Tharp | 343/705 |
| 3,829,861 | 8/1974 | Karaganis et al. | 343/707 |
| 4,110,724 | 8/1978 | Peters | 340/4 A |
| 4,236,234 | 11/1980 | McDavid et al. | 367/77 |

FOREIGN PATENT DOCUMENTS

| | | | |
|---|---|---|---|
| 399543 | 10/1933 | United Kingdom | 343/705 |

*Primary Examiner*—William L. Sikes
*Assistant Examiner*—Doris J. Johnson
*Attorney, Agent, or Firm*—W. G. Sutcliff

[57] ABSTRACT

The present invention relates to an airborne trailing cable-antenna which is multi-sectional. The cable-antenna comprises an electromagnetic radiating portion for the transmission of electromagnetic energy and a non-radiating portion which because of its weight, length, density and other aerodynamic characteristics provides the physical length necessary for the propagation of the radiated electromagnetic energy in a vertical polarized plane. This improved, multi-sectional, trailing, airborne cable-antenna facilitates the transmission of electromagnetic energy in a vertical polarized plane at higher frequencies not previously possible.

6 Claims, 9 Drawing Figures

AIRBORNE TRANSMITTING ANTENNA AND METHOD FOR DEPLOYING SAME

BACKGROUND OF THE INVENTION

1. Field of the Invention

The present invention relates to an airborne trailing cable-antenna which is operated in a vertical orientation in order to transmit vertically polarized electromagnetic signal energy.

2. Description of the Prior Art

It is necessary to transmit radio messages to submarines at sea. The standard method utilizes an aircraft trailing an airborne radiating antenna, wherein the antenna hangs vertically from the aircraft orbiting the ocean. The orbiting characteristics of the aircraft, and the aerodynamics of the antenna, are critical during the tuning of the antenna prior to transmission. The standard one-half wavelength antenna, dependent upon the transmitting frequency (17 kHz-60 kHz) can be in the order of 25,000 feet (7621.95 m) in length. If it is desirous to transmit at higher frequencies, the length of the trailing airborne antenna is proportionally shorter.

The deployment of a trailing airborne antenna is frequency dependent. The length of the deployed antenna must be approximately one-half wavelength of the transmitting frequency to achieve optimum tuning and resonance. In the past and with the aircraft in present use, it has been impractical to deploy a vertical trailing antenna from an aircraft at frequencies higher than 30 kHz. The antenna length at higher frequencies was too short to deploy the antenna vertically because of the aerodynamic requirements of the aircraft in flight. The shortened antenna, due to the flight pattern capabilities of the deploying aircraft and the aerodynamics of the antenna, was deployed trailing the aircraft in a horizontal mode, parallel to the ground. Electromagnetic energy transmission in the horizontal mode resulted in electromagnetic energy propagation in a horizontal polarized plane. Deployment of a trailing airborne antenna at the lower frequencies 17 to 30 kHz requires a much longer antenna. The longer antenna when deployed, dependent upon the orbital characteristics of the aircraft, transmitted electromagnetic energy in a vertical polarized plane. The aircraft, orbiting with a trailing antenna at a lower frequency, allowed the antenna to drop vertically from the aircraft and hang vertically during orbit. The electromagnetic energy was transmitted from the antenna in a vertical polarized plane resulting in electromagnetic energy propagation effective over long distances.

The problem to be solved is; the deployment of a trailing airborne antenna with sufficient antenna cable length to permit the vertical propagation of electromagnetic energy via a vertical polarized plane, when the transmission frequency to be tuned and resonated is greater than 30 kHz.

Airborne antennas have been utilized over the years. For example, U.S. Pat. No. 3,724,817 "A Long Line Loiter Technique" patented by J. C. Simmons Dec. 10, 1970 teaches a plane with a tow line tethered to the plane and a high drag device wherein the line is stalled by the drag device while the plane circles. This high drag cone slidably mounted on the line serving as a parachute or drag for the line was added to the tethered line to eliminate knotting and to hold constant the tension of the line while the plane was in the orbit mode.

U.S. Pat. No. 2,432,371 "Trailing Antenna" by F. J. Berberich patented Nov. 3, 1942 teaches only a trailing antenna improvement which allows the antenna to be reeled inward or outward without tangling within the plane's fuselage area. This was achieved by attaching a cable and weight onto the end of the antenna so that in the trailing or travel mode of the plane the extended or dispensed cable-antenna remained in a position parallel to the flight of the plane.

U.S. Pat. No. 4,110,724 "Apparatus for the Transmission of Messages by Means of Electromagnetic Means" patented by J. Peters Aug. 29, 1978 teaches an apparatus for the long range transmission of messages by means of electromagnetic waves. This apparatus consisted of a long wave transmitting plant with message storing unit, a transmitter and an antenna whose overall physical length equaled one-half the length of the emitted waves or multiples thereof. The key to this patented invention, however, was a means for hoisting the antenna which included a peripheral parachute and related gear into the air from a submarine. This entire concept evolved due to the prior art antenna being hoisted by balloons.

U.S. Pat. No. 3,823,402 entitled "Antenna Deployed from Aircraft to Contact a Body of Water for Length Reduction" by N. B. Tharp patented July 9, 1974 teaches a method and apparatus for radiating low frequency radio waves. The physical length of the antenna is reduced by one-half and the distance is one-quarter of the wavelength of the radio wave to be radiated. The antenna had suitable low resistance connection provided by a drogue and the length of the antenna depended on the height of the aircraft above water.

SUMMARY OF THE INVENTION

There is provided a new and improved combination of an aircraft of predetermined flight pattern capabilities, a transmitting means operable at low frequencies, an elongated cable-antenna having a free end and predetermined length, weight, density and electrical characteristics, a reel means and a drogue attached to the free end of the elongated cable-antenna for the radiation of high frequency waves in a vertical polarized electromagnetic plane. A method of deployment is also provided.

To enable the improved cable-antenna to vertically transmit polarized electromagnetic energy of a predetermined frequency greater than 30 kHz, the cable-antenna is formed in separate joined sections. One of the cable-antenna sections is furthest from the aircraft during cable-antenna deployment and is of a non-radiating nature. The section of the cable-antenna closest to the aircraft during cable-antenna deployment is dispensed from the interior of the aircraft by the reel means and is capable of radiating high frequency electromagnetic signal energy. The reel means is operable to dispense a predetermined length of the cable-antenna, including a predetermined length of the radiating section of the cable-antenna. The dispensed portion of the signal radiating portion of the cable-antenna has a preferred length which approximates one-half wavelength of the predetermined frequency transmitted.

In a further aspect of this invention, the cable-antenna has a uniform exterior diameter for the entire length of the cable-antenna to facilitate the dispensing and reeling in of the cable-antenna during operation and in still another feature of this invention. The multi-sectional cable-antenna's radiating portion comprises a multi-strand wire structure of low electrical resistance material carried about a central core of a metallic highly transmissive material, i.e. steel. The multi-sectional cable-antenna's non-radiating portion is a physically strong, lightweight, high insulating nonmetallic material.

Finally, the method of transmitting from an orbiting aircraft of predetermined flight pattern capabilities vertically polarized electromagnetic signal energy having a predetermined frequency greater than 30 kHz includes; deploying from the orbital aircraft an elongated cable-antenna having predetermined length, weight and density that when suspended from the orbiting aircraft nearly all of the cable-antenna hangs vertically from the aircraft. Further, this cable-antenna comprises both a radiating and non-radiating portion, the radiation portion having an overall radiating length which approximates one-half wavelength of the predetermined electromagnetic signal energy being transmitted. While in flight, the cable-antenna, hanging vertically from the orbiting aircraft is fine tuned to the proper length by raising or lowering the cable-antenna an amount sufficient so that the effective length of the cable-antenna radiating portion closely approximates one-half wavelength of the predetermined electromagnetic energy being transmitted.

BRIEF DESCRIPTION OF THE DRAWINGS

For a better understanding of the invention reference may be had to the preferred embodiment exemplary of the invention shown in the accompanying drawings, in which.

DESCRIPTION OF THE PREFERRED EMBODIMENTS

Figure 1:
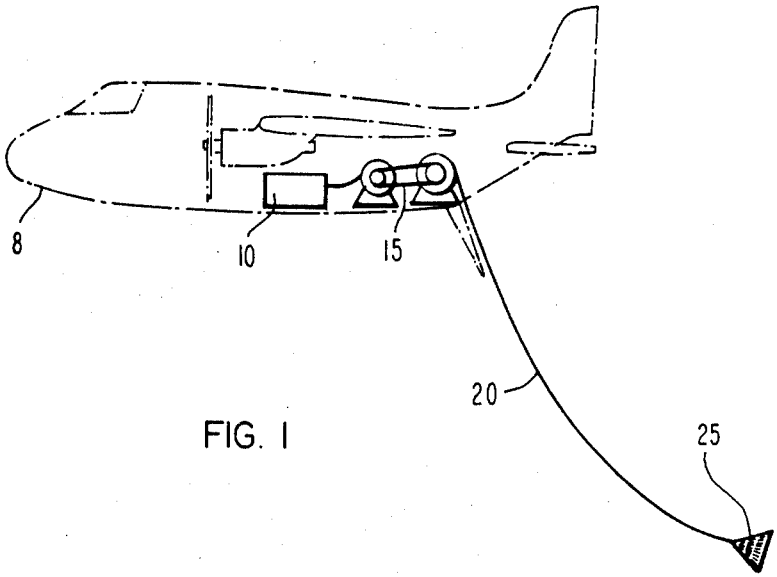
FIG. 1 is a cross section illustrating the arrangement of the transmitter, the reel means, the cable-antenna and the drogue as affixed to the airplane.
Figure 2:
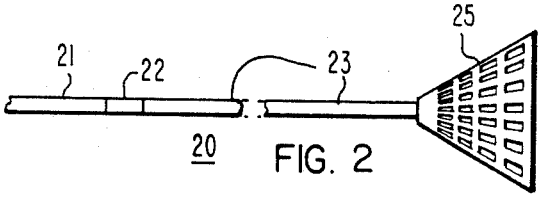
FIG. 2 is a drop view of the cable-antenna.

With regard to FIG. 1, there is shown a representation of the aircraft 8 in linear flight as utilized in combination with this invention. When referring to an aircraft in this application, reference is made to an aircraft 8 capable of transporting the preferred embodiment of the invention as it will be deployed over the ocean in its effort to communicate with submarines, for example. In current application the so-called TACAMO aircraft is useful and is similar to the Lockhead C-130 utilized for strategic communication roles with submarines. As shown in FIG. 1, the transmitter 10 is capable of transmission at frequencies higher than 30 kHz and is interconnected to the reel means 15. The reel means 15 is capable of containing the cable-antenna 20 with its attached drogue 25. This reel means 15 will hold the cable-antenna 20 during takeoff and landing maneuvers and will also dispose the cable-antenna 20 when the aircraft 8 is in flight. The cable-antenna 20 is a multi-sectional apparatus comprising, as shown in FIG. 2, three mandatory sections and one optional section. As detailed in the plan view of FIG. 2, the section nearest the aircraft 8 during deployment of the cable-antenna 20 will be the radiating portion 21 of the cable-antenna portion 20. Radiating portion 21 will be capable of radiating electromagnetic energy during message transmission. Interconnecting the radiating portion 21 and the non-radiating portion 23 of the cable-antenna 20 is an optional insulating means 22. The non-radiating portion 23 of the cable-antenna 20 is the portion furthest from the aircraft 8 during cable-antenna 20 deployment. Attached to the extreme end of the non-radiating portion 23 is the drogue device 25.

Figure 3B:
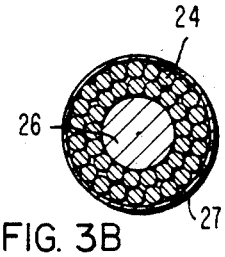
FIG. 3B is a cross section of the radiating portion of the cable-antenna.
Figure 3A:
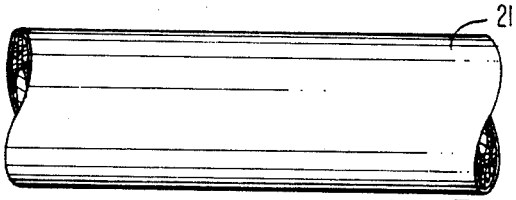
FIG. 3A is a plan view of a short segment of the antenna radiating portion.

FIGS. 3A and 3B include a cross-section view of the radiating portion 21 of the cable-antenna 20. This radiating portion 21 further comprises a multi-strand wire structure of low electrical resistance metal in a bundled configuration 24 and a central core of a high tensile strength metal i.e., steel cable 26. The multi-strand wire structure of low electrical resistance metal in a bundled configuration 24 may be of such metals as aluminum or copper, and, an outside diameter of 3/8 inch (0.925 cm) would be within the range now utilized in the field.

Figure 3D:
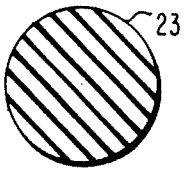
FIG. 3D is a cross section of the non-radiating portion of the cable-antenna.
Figure 3C:
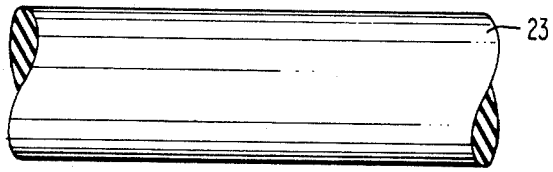
FIG. 3C is a plan view of a short segment of the non-radiating antenna portion.

Covering the steel core 26 and its enwrapped multi-strand wire structure bundles of low electrical resistance metal 24 is a thin layer of non-corrosive metal material 27. The thin layer of non-corrosive metal material 27 will serve as protection from the elements of the radiating portion 21. FIGS. 3C and 3D include a cross section of the non-radiating portion 23 of the cable-antenna 20. The non-radiating portion 23 of the cable-antenna 20 must provide the aerodynamic characteristics of the cable-antenna 20. The non-radiating portion 23 must be made of electrical insulating material of high density, lightweight and adequate physical strength. Materials applicable for use as the non-insulating portion 23 would be, for example, polytetrafluoroethylene ("TEFLON") or "KEVLAR", both trademark materials of E. I. DuPont de Nemours & Company. Both the radiating 21 and non-radiating 23 portions of the cable-antenna 20 should be of identical outside diameter to facilitate deployment of the cable-antenna 20 over the reel means 15.

Figure 4:
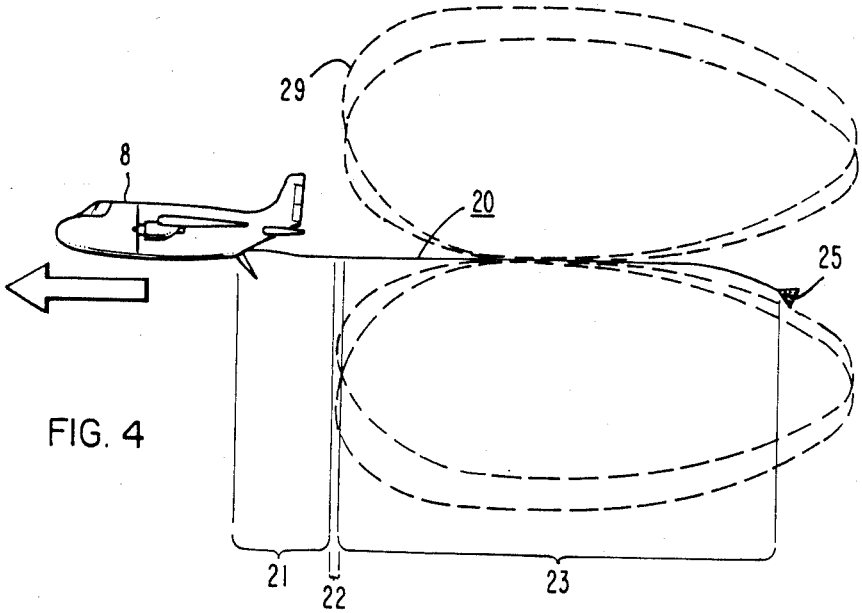
FIG. 4 is a plan view of the airplane in flight trailing the antenna and drogue.

FIG. 4 shows the aircraft 8 in linear flight with the cable-antenna 20 partially disposed. In linear flight, the trailing cable-antenna 20 with attached drogue 25 will trail in a horizontal manner from the rear of the aircraft 8. Any transmission made during linear flight of the aircraft 8 by the transmitter 10 would be in the horizontal polarized plane 29 as afforded by the horizontally trailing cable-antenna 20. During linear flight, the drogue 25 attached to the extreme free end of the nonradiating portion 23 of the cable-antenna 20 provides necessary aerodynamic lift and drag to keep the cable-antenna 20 taut.

Figure 5:
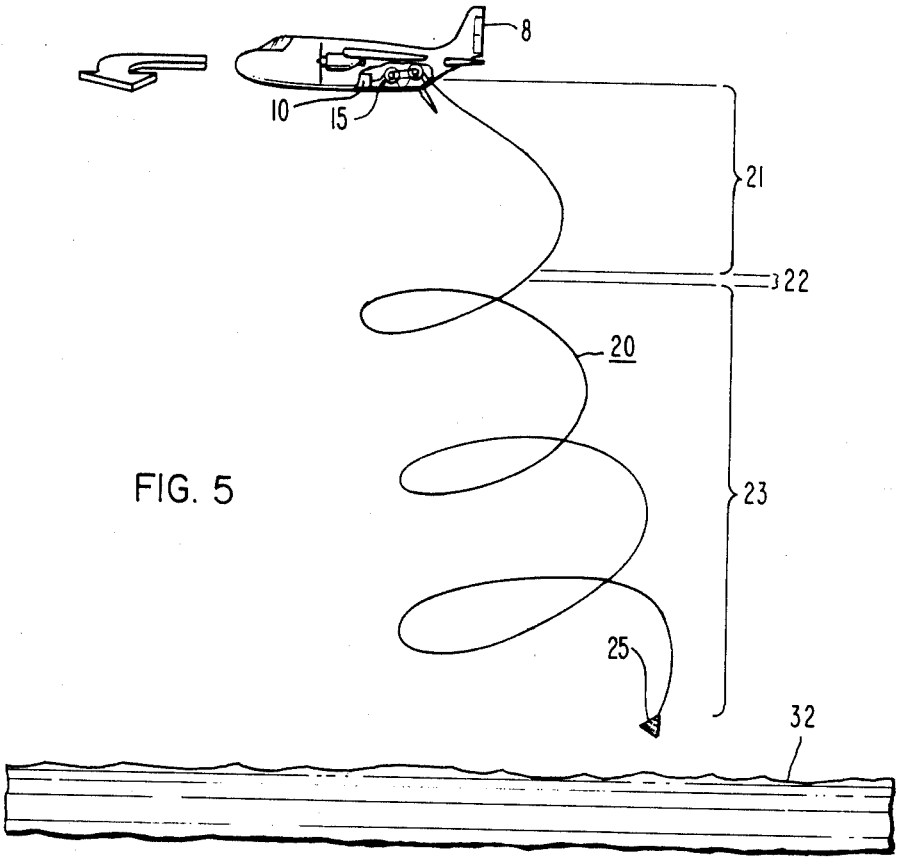
FIG. 5 is the plane beginning its circular orbit also showing the same elements as FIG. 4.

In FIG. 5 the aircraft 8 has begun to orbit in a fixed position over the ocean 32. Antennas can be deployed over any type of surface, however, they are usually deployed over the sea for safety reasons. The reel means 15 now dispenses the entire length of the radiating portion 21 of the cable-antenna 20. The cable-antenna 20 and drogue 25 no longer trail behind the aircraft 8 and begin to drop, due to the gravitational pull of the earth, vertically towards the ocean 32. The cable-antenna 20 tends to drop in a conical helix configuration towards the ocean 32.

The approximate length of the cable-antenna radiating portion 21 can be calculated using the following:

$$\lambda = \frac{c}{f}$$

where:

c=2.998 meters/second the speed of light,
λ=the wavelength of the signal in meters,
λ/2=the length of the antenna, and
f=the frequency of the signal in kHz.

For example, at lower frequencies a standard, fully radiating antenna may be used. If it is desired to transmit at 20 kHz, the length of the antenna for one-half wavelength transmission would be:

$$\lambda = \frac{c}{f}$$

$$\lambda = \frac{2.998 \times 10^8}{20 \times 10^3}$$

$$\lambda = \frac{2.998 \times 10^8}{2.0 \times 10^4}$$

$$= 1.499 \times 10^4 \text{ meters}$$

$$= 14{,}990 \text{ meters}$$

where:

$$\lambda/2 = 49{,}167.2 \text{ feet}$$

$$= 24{,}583.6 \text{ feet}$$

If, however, it were desired to transmit at 60 kHz, the length of the antenna for one-half wavelength transmission would be:

$$\lambda = \frac{c}{f}$$

$$\lambda = \frac{2.998 \times 10^8}{60 \times 10^3}$$

$$= \frac{2.998 \times 10^8}{0.6 \times 10^5}$$

$$= 4.996 \times 10^3 \text{ meters}$$

$$= 4996.6 \text{ meters}$$

where $$\lambda/2 = 16{,}388.8 \text{ feet,}$$

$$= 8{,}194.5 \text{ feet.}$$

The higher the transmitting frequency, the shorter the antenna trailing the aircraft will become to provide optimum tuning and resonance.

Figure 6:
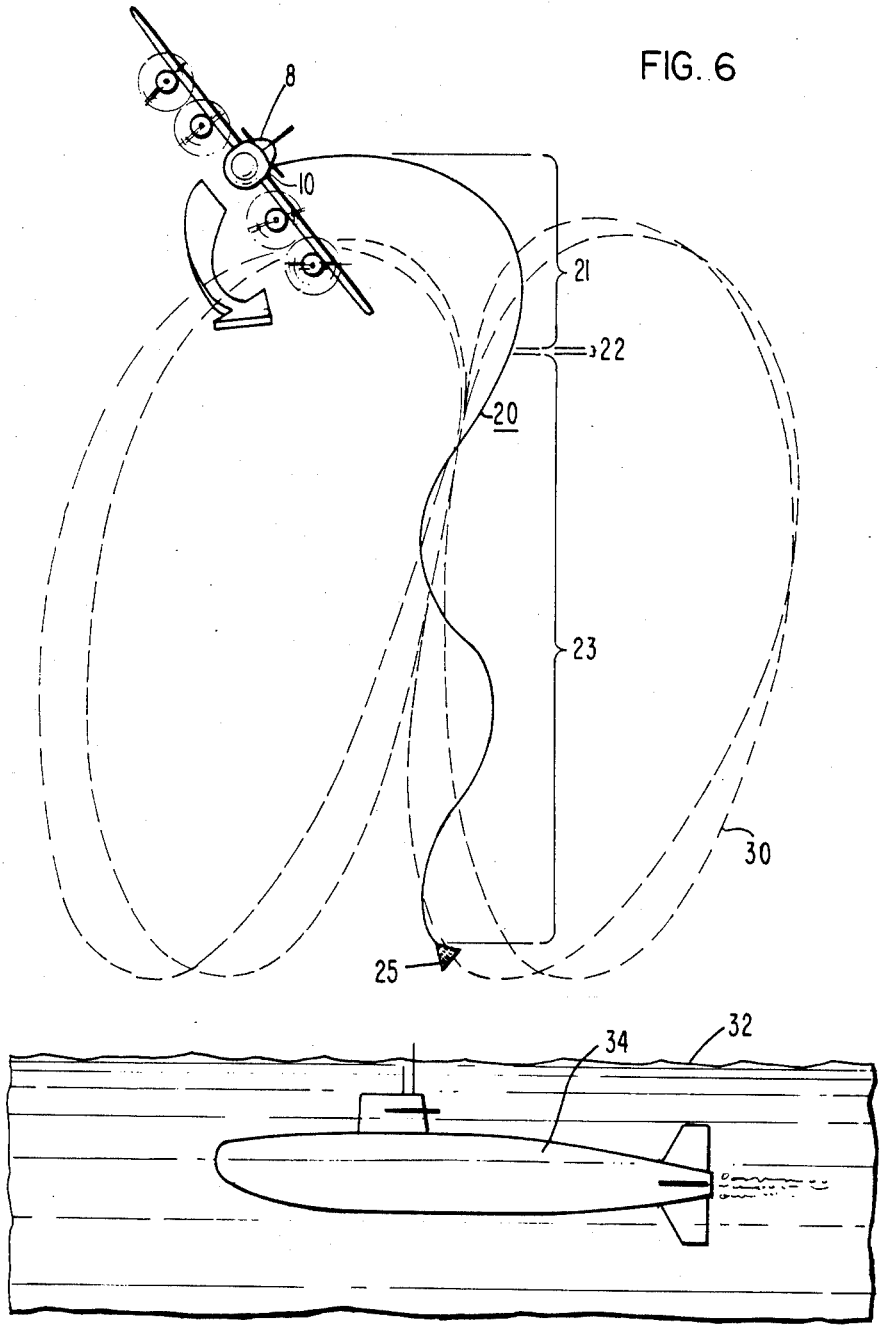
FIG. 6 is the plane in a circular orbit, the antenna and drogue in a vertical polarized plane.

FIG. 6 is a plan view of the aircraft 8 in a circular orbit over the ocean 32. The aircraft 8 serves as a fixed point from which the cable-antenna 20 hangs substantially vertically over the ocean 32. Beneath the ocean 32, submarine 34 awaits a message transmission from the aircraft 8. The aircraft 8 begins transmission via activation of the transmitter 10 located within the aircraft 8. The radiating portion 21 of the cable-antenna 20 is of predetermined length suitable for the transmission of the message. The electromagnetic energy radiates from the radiating portion 21 of the cable-antenna 20 in a vertical polarized plane 30. During transmission, the non-radiating portion 23 and the drogue 25 aerodynamically approximate a physically longer antenna, maintaining the vertical polarized plane 30 during the aircraft's 8 circular orbit. The vertical polarized plane 30 of electromagnetic energy propagation in all azimuths above the ocean 32 and, it will be received by the submarine 34.

Numerous variations may be made in the above-described combination and different embodiments of this invention may be made without departing from the spirit thereof; therefore, it is intended that all matter contained in the foregoing description and in the accompanying drawings whall be interpreted as illustrative and not in a limiting sense.

I claim:

1. In combination with an aircraft means of predetermined flight pattern capabilities and which is operable to transmit vertically polarized electromagnetic signal energy said energy having a predetermined frequency; said aircraft means including a transmitting means for said electromagnetic energy, and an elongated one piece cable-antenna means, said cable-antenna means having a free end, and predetermined length, weight, density and electrical characteristics; a reel means fixed within said aircraft upon said reel means, said cable-antenna means is adapted to be dispensed; and a drogue means affixed to said free end of said cable-antenna means;

wherein when said aircraft is in an orbiting flight pattern and said cable-antenna means is dispensed by said reel means, the majority of said cable-antenna means will hang vertically from said aircraft;

wherein the improved cable-antenna means is operable to transmit vertically polarized electromagnetic energy having a predetermined frequency greater than 30 kHz to be transmitted from said aircraft;

wherein said cable-antenna means is formed of separate joined, non-jointed sections, further said cable-antenna means has a uniform unbroken, uninterrupted, unsegmented exterior diameter from the entire length of said cable-antenna means at least one of said cable-antenna means sections positioned furthest from said aircraft means when said cable-antenna means is dispensed by said reel means, said cable-anntena means section furthest from said aircraft means comprising a non-radiating portion, and the other of said cable-antenna means sections comprising an electromagnetic energy signal radiating portion, further said reel means operable to dispense a predetermined length of said cable-antenna means including a predetermined length of said radiating portion of said cable antenna means, and the dispensed portion of said signal radiating portion of said cable-antenna means having a length which approximates one-half wavelength of said predetermined frequency desired to be transmitted.

2. The combination as specified in claim 1 wherein said radiating portion of said cable-antenna means comprises a multi-strand wire structure of low electrical resistance metal comprising aluminum or copper carried about a central core of a metallic highly transmissive material.

3. The combination as specified in claim 1 wherein said non-radiating portion of said cable-antenna means is a physically strong, lightweight, high insulating non-metallic material.

4. The combination as specified in claim 1 wherein said cable-antenna means comprises a radiating portion and a non-radiating portion separated by an insulating means, said insulating means having the same diameter of said radiating and said non-radiating portions of said cable-antenna means, further said radiating, said non-radiating and said insulating means all having the same diameter and all interconnected without visual break between said portions.

5. A method of transmitting from an orbiting aircraft of predetermined flight pattern capabilities, a vertically polarized electromagnetic signal said vertically polarized electromagnetic signal having a predetermined frequency greater than 30 kHz, said method comprising:

the deployment from said orbiting aircraft an elongated, uniform, uninterrupted diameter, fully flexible cable-antenna means, said cable-antenna means having such predetermined length, weight and density that when said cable-antenna means is suspended from said orbiting aircraft, nearly all of said cable-antenna means will hang vertically from said orbiting aircraft; and further said cable-antenna means comprises at least one radiating portion and at least one non-radiating portion, said radiating and said non-radiating portions of said cable-antenna means joined without a visual break between said portions, further said radiating portion of said cable-antenna means having said length which approximate one-half wavelengths of said predetermined electromagnetic signal energy being transmitted.

6. The method as specified in claim 5 wherein nearly all of said cable-antenna means is having vertically from said orbiting aircraft, the radiating portion of said cable-antenna means is fine tuned to the proper length by raising or lowering said cable-antenna means an amount sufficient that the effective length of said cable-antenna radiating portion closely approximates one-half wavelength of said predetermined electromagnetic energy being transmitted.

* * * * *